US011170729B2

(12) United States Patent
Ahn et al.

(10) Patent No.: US 11,170,729 B2
(45) Date of Patent: Nov. 9, 2021

(54) DISPLAY DEVICE HAVING POWER MANAGEMENT CIRCUIT

(71) Applicant: Samsung Display Co., Ltd., Yongin-Si (KR)

(72) Inventors: Gwangsoo Ahn, Suwon-si (KR); Dae-Sik Lee, Hwaseong-si (KR); Jong Jae Lee, Hwaseong-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/857,106

(22) Filed: Apr. 23, 2020

(65) Prior Publication Data

US 2021/0118391 A1 Apr. 22, 2021

(30) Foreign Application Priority Data

Oct. 21, 2019 (KR) ..... 10-2019-0130611

(51) Int. Cl.
*G09G 3/36* (2006.01)

(52) U.S. Cl.
CPC ..... *G09G 3/3677* (2013.01); *G09G 3/3688* (2013.01); *G09G 2320/045* (2013.01)

(58) Field of Classification Search
CPC combination set(s) only.
See application file for complete search history.

(56) References Cited

U.S. PATENT DOCUMENTS

| | | | | |
|---|---|---|---|---|
| 8,627,119 | B2 | 1/2014 | Barnes et al. | |
| 2006/0158421 | A1* | 7/2006 | Masuko | G09G 3/3688 345/100 |
| 2012/0098430 | A1* | 4/2012 | Inoue | H05B 45/58 315/82 |
| 2013/0261835 | A1* | 10/2013 | Takahashi | G05F 5/00 700/297 |
| 2018/0123516 | A1* | 5/2018 | Kim | H03F 3/19 |
| 2018/0212513 | A1* | 7/2018 | Park | G01R 31/50 |
| 2020/0144916 | A1* | 5/2020 | Lee | H02M 1/36 |
| 2021/0044157 | A1* | 2/2021 | Kawamae | A47K 3/001 |

* cited by examiner

*Primary Examiner* — Van N Chow
(74) *Attorney, Agent, or Firm* — Innovation Counsel LLP

(57) ABSTRACT

A power management circuit of a display device includes a voltage information storage comprising a first and second bank storing first and second voltage information corresponding to first and second voltage levels different from each other, a bank select pin receiving a bank select signal, a voltage information selecting circuit selectively outputting the first voltage information stored in the first bank or the second voltage information stored in the second bank in response to the bank select signal received through the bank select pin, and a DC-DC converter generating panel driving voltages having the first voltage levels based on the first voltage information when the first voltage information is output from the voltage information selecting circuit, and generating the panel driving voltages having the second voltage levels based on the second voltage information when the second voltage information is output from the voltage information selecting circuit.

18 Claims, 12 Drawing Sheets

| | BANK1 (HVI) | BANK2 (NVI) |
|---|---|---|
| AVDD | 18V | 16V |
| HAVDD | 9V | 8V |
| VGH | 40V | 30V |
| VGL | -12V | -8V |

| | BANK1 (2DVI) | BANK2 (3DVI) |
|---|---|---|
| AVDD | 16V | 20V |
| HAVDD | 8V | 10V |
| VGH | 30V | 30V |
| VGL | -8V | -8V |

DISPLAY DEVICE HAVING POWER MANAGEMENT CIRCUIT

CROSS-REFERENCE TO RELATED APPLICATION(S)

This application claims priority to and benefit of Korean Patent Application No. 10-2019-0130611, filed on Oct. 21, 2019 in the Korean Intellectual Property Office (KIPO), the disclosure of the Korean Patent Application is incorporated herein in its entirety by reference.

BACKGROUND

1. Field

The technical field relates to a display device including a power management circuit.

2. Description of the Related Art

Display devices, such as a liquid crystal display (LCD) device, often undergo an aging process after they are assembled. The aging process drives the display device to detect defects caused by a wearing of the display panel over time or use. However, when panel driving voltages (e.g., an analog driving voltage, high and low gate voltages, etc.) used in a normal driving operation of the display device are used in the aging process, the aging process may take an excessive amount of time. To reduce the time of the aging process, a high voltage stress (HVS) aging process has been developed which uses panel driving voltages having levels (or absolute values) higher than those of the panel driving voltages in the normal driving operation.

To perform the HVS aging process, a data writing operation writing voltage information for the panel driving voltages having higher levels to a power management circuit should be performed before the HVS aging process, and a data writing operation writing voltage information for the panel driving voltages in the normal driving operation to the power management circuit should be performed after the HVS aging process. Accordingly, the entire aging process time may be increased due to the added supplementary process time.

SUMMARY

Some example embodiments provide a power management circuit of a display device capable of reducing the entire aging process time for the display device.

Some example embodiments provide a display device capable of reducing the entire aging process time.

According to example embodiments, there is provided a power management circuit of a display device. The power management circuit includes a voltage information storage including a first bank configured to store first voltage information representing first voltage levels and a second bank configured to store second voltage information corresponding to second voltage levels different from the first voltage levels, a bank select pin configured to receive a bank select signal, a voltage information selecting circuit configured to selectively output the first voltage information stored in the first bank or the second voltage information stored in the second bank in response to the bank select signal received through the bank select pin, and a DC-DC converter configured to generate panel driving voltages having the first voltage levels based on the first voltage information when the first voltage information is output from the voltage information selecting circuit, and to generate the panel driving voltages having the second voltage levels based on the second voltage information when the second voltage information is output from the voltage information selecting circuit.

In example embodiments, during an aging process for the display device, the voltage information selecting circuit may receive the bank select signal having a first level through the bank select pin, and may output the first voltage information in response to the bank select signal having the first level. After the aging process, the voltage information selecting circuit may receive the bank select signal having a second level different from the first level through the bank select pin, and may output the second voltage information in response to the bank select signal having the second level.

In example embodiments, during the aging process, the bank select pin may receive the bank select signal from a bridge board coupled to a control board on which the power management circuit is mounted.

In example embodiments, the first voltage information may be high voltage information and the first voltage levels are high voltage levels, and the second voltage information may be normal voltage information and the normal voltage levels are second voltage levels.

In example embodiments, the voltage information selecting circuit may receive the bank select signal having a first level through the bank select pin in a first mode of the display device, and may output the first voltage information in response to receiving the bank select signal having the first level. The voltage information selecting circuit may receive the bank select signal having a second level different from the first level through the bank select pin in a second mode of the display device, and may output the second voltage information in response to receiving the bank select signal having the second level.

In example embodiments, the bank select pin may receive the bank select signal from a timing controller included in the display device.

In example embodiments, the first mode may be a two-dimensional mode in which the display device displays a two-dimensional image, and the second mode may be a three-dimensional mode in which the display device displays a three-dimensional image.

In example embodiments, the first mode may be a standard dynamic range mode in which the display device displays an image with a standard dynamic range, and the second mode may be a high dynamic range mode in which the display device displays an image with a high dynamic range.

In example embodiments, the voltage information storage may be implemented with a nonvolatile memory device.

In example embodiments, the panel driving voltages generated by the DC-DC converter may include an analog driving voltage and a half analog driving voltage provided to a data driver included in the display device, and may further include a high gate voltage and a low gate voltage provided to a gate driver included in the display device.

In example embodiments, the first voltage information may include first transition time information corresponding to a first transition time, and the second voltage information may include second transition time information corresponding to a second transition time. The DC-DC converter may be configured to gradually change the panel driving voltages from the second voltage levels to the first voltage levels for the first transition time in response to the first voltage information, and may gradually change the panel driving voltages from the first voltage levels to the second voltage levels for the second transition time in response to the second voltage information.

According to example embodiments, there is provided a power management circuit of a display device. The power management circuit includes a voltage information storage including N banks configured to collectively store N voltage information, where N is an integer greater than 1, at least one bank select pin configured to receive a bank select signal, a voltage information selecting circuit configured to selectively output one voltage information of the N voltage information stored in the N banks in response to the bank select signal received through the at least one bank select pin, and a DC-DC converter configured to generate panel driving voltages having voltage levels corresponding to the one voltage information based on the one voltage information output from the voltage information selecting circuit.

In example embodiments, the at least one bank select pin comprises M bank select pins, where the M may be an integer that satisfies an equation $N \leq 2^M < 2*N$.

In example embodiments, during an aging process, the at least one bank select pin may receive the bank select signal from a bridge board coupled to a control board on which the power management circuit is mounted.

In example embodiments, the at least one bank select pin may receive the bank select signal from a timing controller included in the display device.

In example embodiments, the panel driving voltages generated by the DC-DC converter may include an analog driving voltage and a half analog driving voltage provided to a data driver included in the display device, as well as a high gate voltage and a low gate voltage provided to a gate driver included in the display device.

According to example embodiments, there is provided a display device including a display panel including a plurality of pixels, a power management circuit configured to generate panel driving voltages, and a panel driver configured to drive the display panel based on the panel driving voltages. The power management circuit includes a voltage information storage including a first bank that stores first voltage information corresponding to first voltage levels and a second bank that stores second voltage information corresponding to second voltage levels different from the first voltage levels, a bank select pin configured to receive a bank select signal, a voltage information selecting circuit configured to selectively output the first voltage information stored in the first bank or the second voltage information stored in the second bank in response to the bank select signal received through the bank select pin, and a DC-DC converter configured to generate the panel driving voltages having the first voltage levels based on the first voltage information when the first voltage information is output from the voltage information selecting circuit, and to generate the panel driving voltages having the second voltage levels based on the second voltage information when the second voltage information is output from the voltage information selecting circuit.

In example embodiments, during an aging process for the display device, the voltage information selecting circuit may receive the bank select signal having a first level through the bank select pin, and may output the first voltage information in response to the bank select signal having the first level. After the aging process, the voltage information selecting circuit may receive the bank select signal having a second level different from the first level through the bank select pin, and may output the second voltage information in response to the bank select signal having the second level.

In example embodiments, during the aging process, the bank select pin may receive the bank select signal from a bridge board coupled to a control board on which the power management circuit is mounted.

In example embodiments, the first voltage information may be high voltage information and the first voltage levels are high voltage levels, and the second voltage information may be normal voltage information and the second voltage levels are normal voltage levels.

As described above, a power management circuit and a display device according to example embodiments may store a plurality of voltage information, may select one of the plurality of voltage information in response to a bank select signal received through a bank select pin, and may generate panel driving voltages having voltage levels represented by the selected voltage information. Accordingly, the voltage levels of the panel driving voltages may be efficiently changed.

Further, the power management circuit and the display device according to example embodiments may generate panel driving voltages having first voltage levels in response to a bank select signal having a first level while an aging process is performed, and may generate the panel driving voltages having second voltage levels in response to the bank select signal having a second level after the aging process is performed. Accordingly, although a plurality of data writing operations that writes different voltage information for the panel driving voltages to the power management circuit is not performed before and after the aging process, the voltage levels of the panel driving voltages may be efficiently changed, and the entire aging process time for the display device may be reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION OF THE EMBODIMENTS

Figure 1:
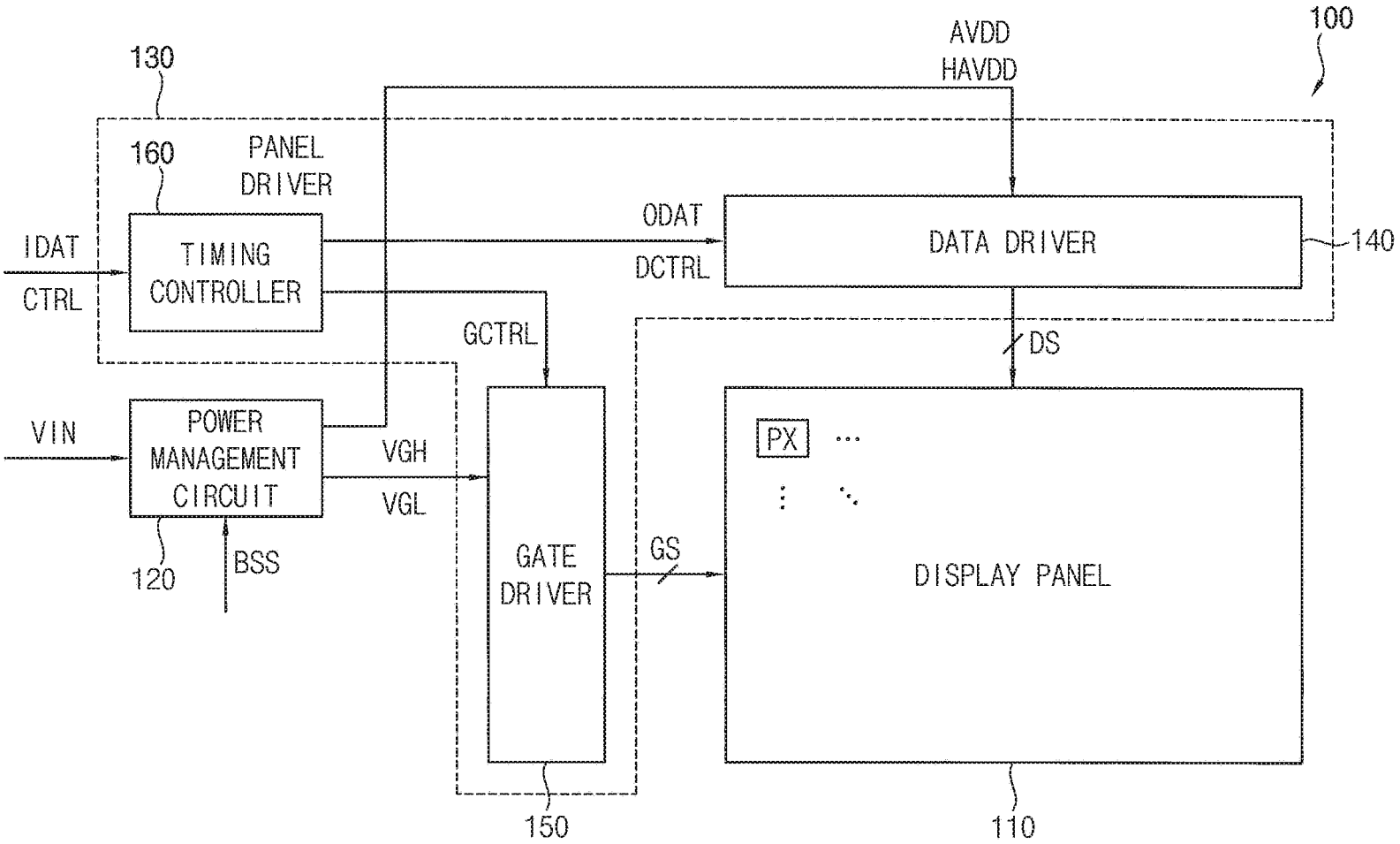
FIG. 1 is a block diagram illustrating a display device according to example embodiments.

Hereinafter, embodiments of the present inventive concept will be explained in detail with reference to the accompanying drawings.

Example embodiments are described with reference to the accompanying drawings, wherein like reference numerals may refer to like elements.

Although the terms "first," "second," etc. may be used to describe various elements, these elements should not be limited by these terms. These terms are used to distinguish one element from another. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

The singular forms "a," "an," and "the" may include the plural forms as well, unless the context clearly indicates otherwise.

Further, an expression that a first element such as a layer, region, substrate or plate is placed "on" or "above" a second element indicates not only a case where the first element is placed "directly on" the other second element but also a case where one or more intervening elements are interposed between the first element and the second element.

The terms "includes" and/or "including", when used in this specification, specify the presence of stated features, integers, steps, operations, elements, and/or components, but do not preclude the presence and/or addition of one or more other features, integers, steps, operations, elements, components, and/or groups thereof.

Sizes of elements in the drawings may be exaggerated for convenience of explanation.

FIG. 1 is a block diagram illustrating a display device according to example embodiments.

Referring to FIG. 1, a display device 100 according to example embodiments may include a display panel 110 including a plurality of pixels PX, a power management circuit 120 that generate panel driving voltages, and a panel driver 130 that drives the display panel 110 based on the panel driving voltages. The panel driver 130 may include a data driver 140 that provides data signals DS to the plurality of pixels PX, a gate driver 150 that provides gate signals GS to the plurality of pixels PX, and a timing controller (TCON) 160 that controls an operation of the display device 100.

The display panel 110 may include a plurality of data lines, a plurality of gate lines, and the plurality of pixels PX coupled to the plurality of data lines and the plurality of gate lines. The display panel 110 may be a liquid crystal display (LCD) panel where each pixel PX includes a switching transistor and a liquid crystal capacitor coupled to the switching transistor, or an organic light emitting diode (OLED) display panel where each pixel PX includes at least one capacitor, at least one transistor and an OLED. The display panel 110 is not limited to the LCD panel and the OLED display panel, and may be any suitable display panel.

The power management circuit 120 may generate the panel driving voltages based on an input voltage VIN provided from an external circuit or an external device. The panel driving voltages generated by the power management circuit 120 may include an analog driving voltage AVDD and a half analog driving voltage HAVDD provided to the data driver 140, and a high gate voltage VGH and a low gate voltage VGL provided to the gate driver 150. The power management circuit 120 may include a gamma reference voltage generator that generates a gamma reference voltage based on the analog driving voltage AVDD and/or the input voltage VIN. The gamma reference voltage provided to the data driver 140 is considered one of the panel driving voltages. For example, the gamma reference voltage may include, a positive high (or upper-high) gamma reference voltage having the highest voltage level, a negative low (lower-low) gamma reference voltage having the lowest voltage level, and a positive low (upper-low) gamma reference voltage and a negative high (lower-high) gamma reference voltage between the positive high gamma reference voltage and the negative low gamma reference voltage. Furthermore, the power management circuit 120 may include a common voltage generator that generates a common voltage based on the analog driving voltage AVDD and/or the input voltage VIN. The panel driving voltages may include the common voltage provided to the display panel 110. The power management circuit 120 may be implemented with a power management integrated circuit (PMIC) mounted on a control board (e.g., a control printed circuit board (PCB) or a control printed board assembly (PBA)) where the timing controller 160 is located.

The data driver 140 may receive the analog driving voltage AVDD and the half analog driving voltage HAVDD from the power management circuit 120, and may receive output image data ODAT and a data control signal DCTRL output from the timing controller 160. The data driver 140 may further generate the data signals DS based on the analog driving voltage AVDD, the half analog driving voltage HAVDD, the output image data ODAT and the data control signal DCTRL. The data driver 140 may then provide the data signals DS to the plurality of pixels PX. For example, the data driver 140 may generate gray voltages (e.g., 256 gray voltages) respectively corresponding to the entire gray levels (e.g., from a 0-gray level to a 255-gray level) based on the analog driving voltage AVDD, the half analog driving voltage HAVDD and/or the gamma reference voltage, and may output, as the data signals DS, the gray voltages corresponding to gray levels represented by the output image data ODAT to the plurality of pixels PX. The data driver 140 may perform a polarity inversion operation that alternately uses positive gray voltages and negative gray voltages. Output buffers of the data driver 140 may output the positive gray voltages based on the analog driving voltage AVDD and the half analog driving voltage HAVDD, and may output the negative gray voltages based on the half analog driving voltage HAVDD and a ground voltage. Thus, a power consumption of the data driver 140 may be reduced compared with a data driver that do not use the half analog driving voltage HAVDD. The data control signal DCTRL may include a horizontal start signal and a load signal. The data driver 140 may be implemented with one or more data driver integrated circuits (ICs). For example, the one or more data driver ICs may be mounted on a flexible film coupled to the display panel 110 in a chip on film (COF) manner, or may be mounted on the display panel 110 in a chip on glass (COG) manner or a chip on plastic (COP) manner.

The gate driver 150 may receive the high gate voltage VGH and the low gate voltage VGL from the power management circuit 120, and may receive a gate control signal GCTRL from the timing controller 160. The gate driver 150 may further generate the gate signals GS based on the high gate voltage VGH, the low gate voltage VGL and the gate control signal GCTRL, and may sequentially provide the gate signals GS to the plurality of pixels PX on a row-by-row basis. For example, the gate control signal GCTRL may include a gate start signal and a gate clock signal. The gate driver 150 may be implemented as an amorphous silicon gate (ASG) driver integrated in a peripheral portion of the display panel 110, or the gate driver 150 may be implemented with one or more gate driver ICs. Furthermore, the gate driver 150 may be mounted on a flexible film coupled to the display panel 110 in a COF manner, or may be mounted on the display panel 110 in a COG manner or a COP manner.

The timing controller 160 may receive input image data IDAT and a control signal CTRL from an external host processor (e.g., a graphic processing unit (GPU) or a graphic card). For example, the input image data IDAT may be RGB image data including red image data, green image data and blue image data. Furthermore, the control signal CTRL may include a vertical synchronization signal, a horizontal synchronization signal, a data enable signal, a master clock signal, and other such similar signals. The timing controller 160 may generate the output image data ODAT, the data control signal DCTRL and the gate control signal GCTRL based on the input image data IDAT and the control signal CTRL. The timing controller 160 may control an operation of the data driver 140 by providing the output image data ODAT and the data control signal DCTRL to the data driver 140, and may control an operation of the gate driver 150 by providing the gate control signal GCTRL to the gate driver 150. The timing controller 160 may be implemented with an integrated circuit, and may be mounted on the control board (e.g., the control PCB or the control PBA) along with the power management circuit 120.

In the display device 100 according to example embodiments, the power management circuit 120 may respectively store a plurality of voltage information in a plurality of banks, select one voltage information from among the plurality of voltage information in response to a bank select signal BSS received through a bank select pin, and generate the panel driving voltages having voltage levels represented by the selected voltage information. Accordingly, the voltage levels of the panel driving voltages may be efficiently changed. During the aging process, the power management circuit 120 may generate the panel driving voltages having first voltage levels (e.g., high voltage levels) in response to the bank select signal BSS having a first level. After an aging process, the power management circuit 120 may generate the panel driving voltages having second voltage levels (e.g., normal voltage levels) in response to the bank select signal BSS. Accordingly, though a plurality of data writing operations that writes different voltage information for the panel driving voltages to the power management circuit 120 is not performed before and after the aging process, the voltage levels of the panel driving voltages may be efficiently changed, and the entire aging process time for the display device 100 may consequently be reduced. In embodiments, the power management circuit 120 may generate the panel driving voltages having first voltage levels in response to the bank select signal BSS having a first level in a first mode (e.g., a two-dimensional (2D) mode, a standard dynamic range (SDR) mode, etc.), and may generate the panel driving voltages having second voltage levels in response to the bank select signal BSS having a second level in a second mode (e.g., a three-dimensional (3D) mode, a high dynamic range (HDR) mode, etc.). Accordingly, the voltage levels of the panel driving voltages may be efficiently changed according to an operating mode of the display device 100.

Figure 2:
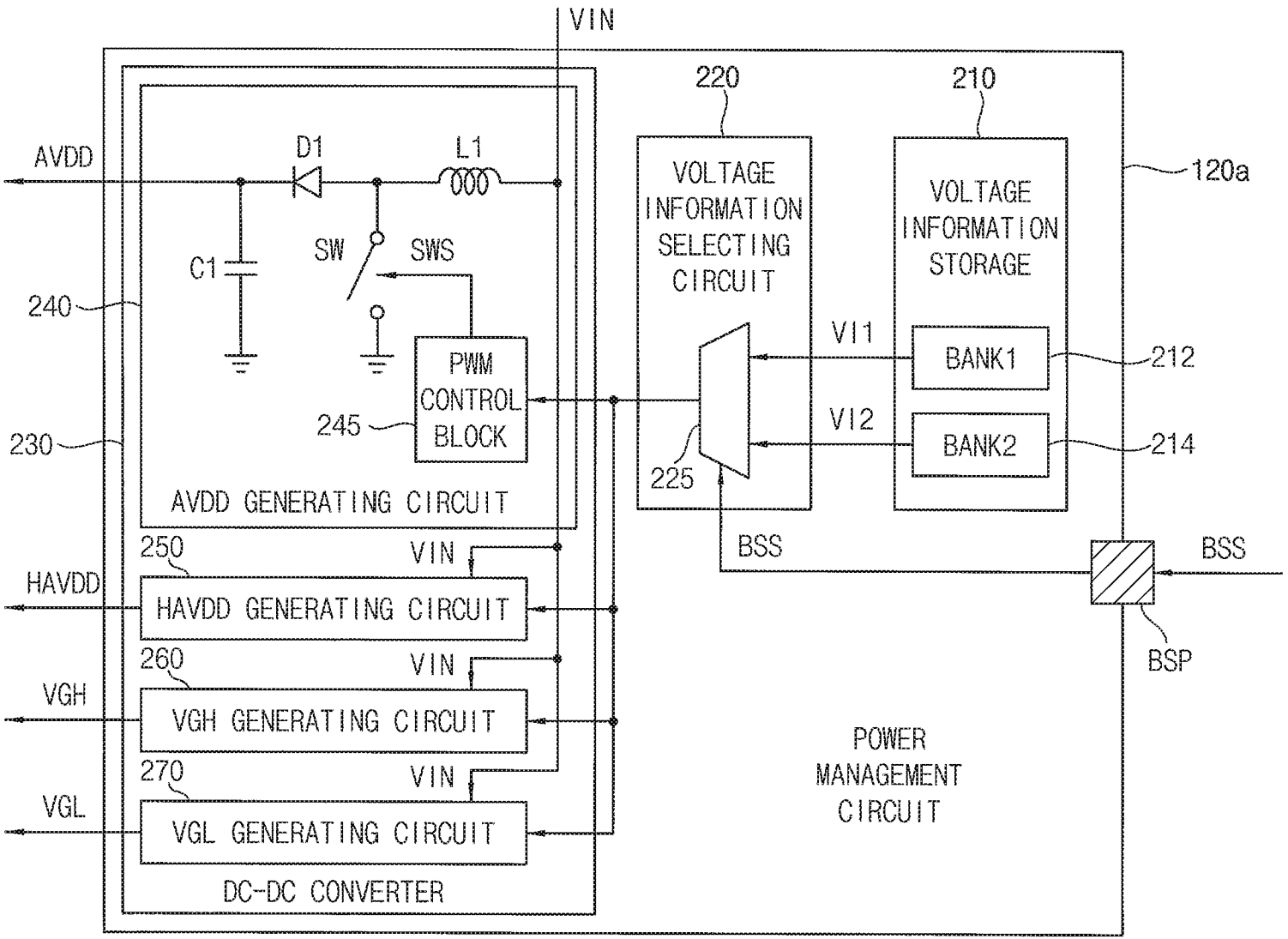
FIG. 2 is a block diagram illustrating a power management circuit according to example embodiments.

FIG. 2 is a block diagram illustrating a power management circuit according to example embodiments.

Referring to FIG. 2, a power management circuit 120*a* of a display device according to example embodiments may include a voltage information storage 210, a bank select pin BSP, a voltage information selecting circuit 220 and a direct current-to-direct current (DC-DC) converter 230.

The voltage information storage 210 may include a first bank (BANK1) 212 that stores first voltage information VI1 representing (e.g., expressing or corresponding to) first voltage levels, and a second bank (BANK2) 214 that stores second voltage information VI2 representing second voltage levels different from the first voltage levels. Here, the first and second banks 212 and 214 may be different physical memory units that are physically divided, or may be storage areas that are logically divided within the same physical memory unit. The first voltage information VI1 stored in the first bank 212 may be high voltage information representing high voltage levels as the first voltage levels, and the second voltage information VI2 stored in the second bank 214 may be normal voltage information representing normal voltage levels as the second voltage levels. Here, the high voltage levels may have absolute values higher than the normal voltage levels. The voltage information storage 210 may be implemented with a nonvolatile memory device that retains data even while power is not supplied. For example, the voltage information storage 210 may be implemented with an electrically erasable programmable read-only memory (EEPROM), a flash memory device, etc. In embodiments, the voltage information storage 210 may be implemented with a volatile memory device.

The bank select pin BSP may receive a bank select signal BSS. While an aging process for the display device including the power management circuit 120*a* is performed, the bank select pin BSP may receive the bank select signal BSS having a first level from a bridge board coupled to a control board on which the power management circuit 120*a* is mounted. Furthermore, a line on the control board through which the bank select signal BSS is transferred may be coupled to a pull-down termination resistor, and the bank select pin BSP may receive the bank select signal BSS having a second level by the pull-down termination resistor while the aging process is not performed.

The voltage information selecting circuit 220 may selectively output the first voltage information VI1 stored in the first bank 212 or the second voltage information VI2 stored in the second bank 214 in response to the bank select signal BSS received through the bank select pin BSP. As illustrated in FIG. 2, the voltage information selecting circuit 220 may include a multiplexer 225 that operates in response to the bank select signal BSS received through the bank select pin BSP. For example, the multiplexer 225 may output the first voltage information VI1 in response to receiving the bank select signal BSS having a first level, and may output the second voltage information VI2 in response to receiving the bank select signal BSS having a second level.

The DC-DC converter 230 may generate panel driving voltages having the first voltage levels based on the first voltage information VI1 or the second voltage information VI2, depending on which it receives from the voltage information selecting circuit 220. The panel driving voltages generated by the DC-DC converter 230 may include an analog driving voltage AVDD and a half analog driving voltage HAVDD provided to a data driver, and may further include a high gate voltage VGH and a low gate voltage VGL provided to a gate driver. The panel driving voltages may further include a gamma reference voltage, a common voltage, and other similar voltages Each voltage information (e.g., the first voltage information VI1 or the second voltage information VI2) provided from the voltage information selecting circuit 220 to the DC-DC converter 230 may represent a voltage level of the analog driving voltage AVDD, a voltage level of the half analog driving voltage HAVDD, a voltage level of the high gate voltage VGH, and a voltage level of the low gate voltage VGL.

As illustrated in FIG. 2, the DC-DC converter 230 may include an analog driving voltage generating circuit 240 that generates the analog driving voltage AVDD based on an input voltage VIN provided from an external circuit or an external device. The analog driving voltage generating circuit 240 may convert the input voltage VIN into the analog driving voltage AVDD having a voltage level represented by the voltage information (e.g., the first voltage information VI1 or the second voltage information VI2) selected by the voltage information selecting circuit 220. For example, the analog driving voltage generating circuit 240 may be implemented with a boost converter including an inductor L1, a switching element SW, a diode D1, a capacitor C1 and a pulse width modulation (PWM) control block 245. The PWM control block 245 may change a pulse width or a duty of a switching signal SWS applied to the switching element SW according to the voltage level of the analog driving voltage AVDD represented by the selected voltage information.

The DC-DC converter 230 may further include a half analog driving voltage generating circuit 250 that generates the half analog driving voltage HAVDD based on the input voltage VIN and/or the analog driving voltage AVDD, a high gate voltage generating circuit 260 that generates the high gate voltage VGH based on the input voltage VIN and/or the analog driving voltage AVDD, and a low gate voltage generating circuit 270 that generates the low gate voltage VGL based on the input voltage VIN and/or the analog driving voltage AVDD. Each of the half analog driving voltage generating circuit 250, the high gate voltage generating circuit 260 and the low gate voltage generating circuit 270 may be implemented in any type of converter, such as a boost converter, a buck converter, and a buck-boost converter. The half analog driving voltage generating circuit 250 may convert the input voltage VIN or the analog driving voltage AVDD into the half analog driving voltage HAVDD having a voltage level represented by the selected voltage information. The high gate voltage generating circuit 260 may convert the input voltage VIN or the analog driving voltage AVDD into the high gate voltage VGH having a voltage level represented by the selected voltage information. The low gate voltage generating circuit 270 may convert the input voltage VIN or the analog driving voltage AVDD into the low gate voltage VGL having a voltage level represented by the selected voltage information.

As described above, the power management circuit 120*a* may generate the panel driving voltages having the first voltage levels (e.g., the high voltage levels) in response to the bank select signal BSS having the first level received through the bank select pin BSP from the bridge board while the aging process is performed. While the aging process is not being performed, the power management circuit 120*a* may generate the panel driving voltages having the second voltage levels (e.g., the normal voltage levels) in response to the bank select signal BSS having the second level received through the bank select pin BSP. Accordingly, although a plurality of data writing operations that writes different voltage information for the panel driving voltages to the power management circuit 120*a* is not performed before and after the aging process, the panel driving voltages having the high voltage levels may be generated during the aging process, and the panel driving voltages having the normal voltage levels may be generated after the aging process. Accordingly, the aging process may be efficiently performed by using the panel driving voltages having the high voltage levels, and the entire aging process time for the display device may be reduced.

Figure 3:
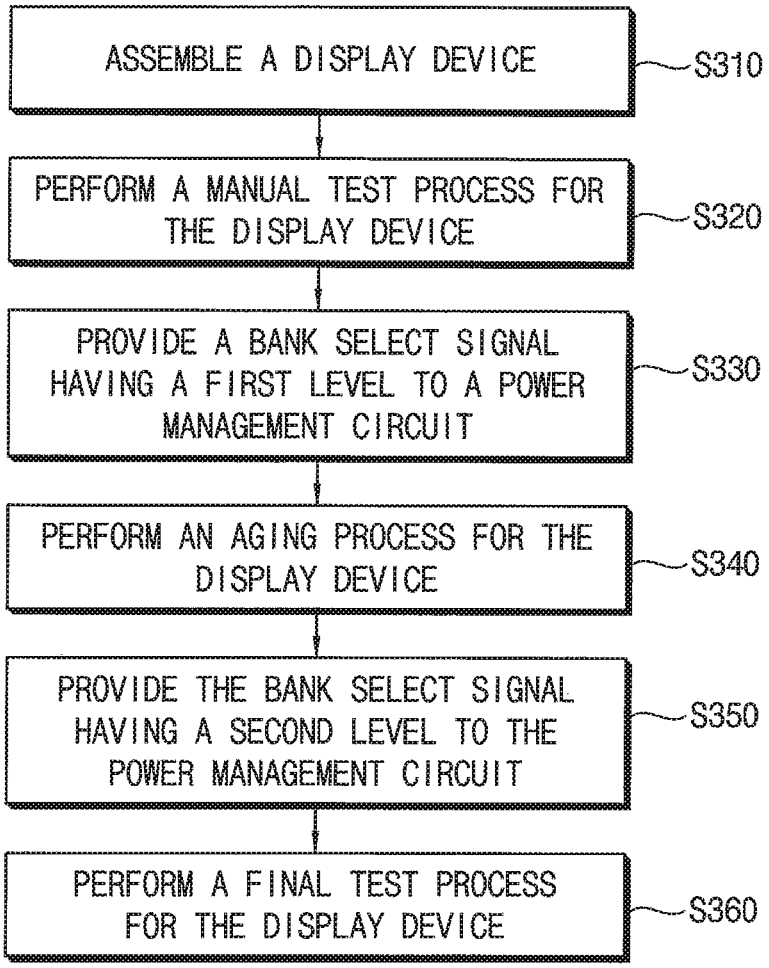
FIG. 3 a flowchart illustrating a test process for a display device according to example embodiments.
Figures 4, 5:
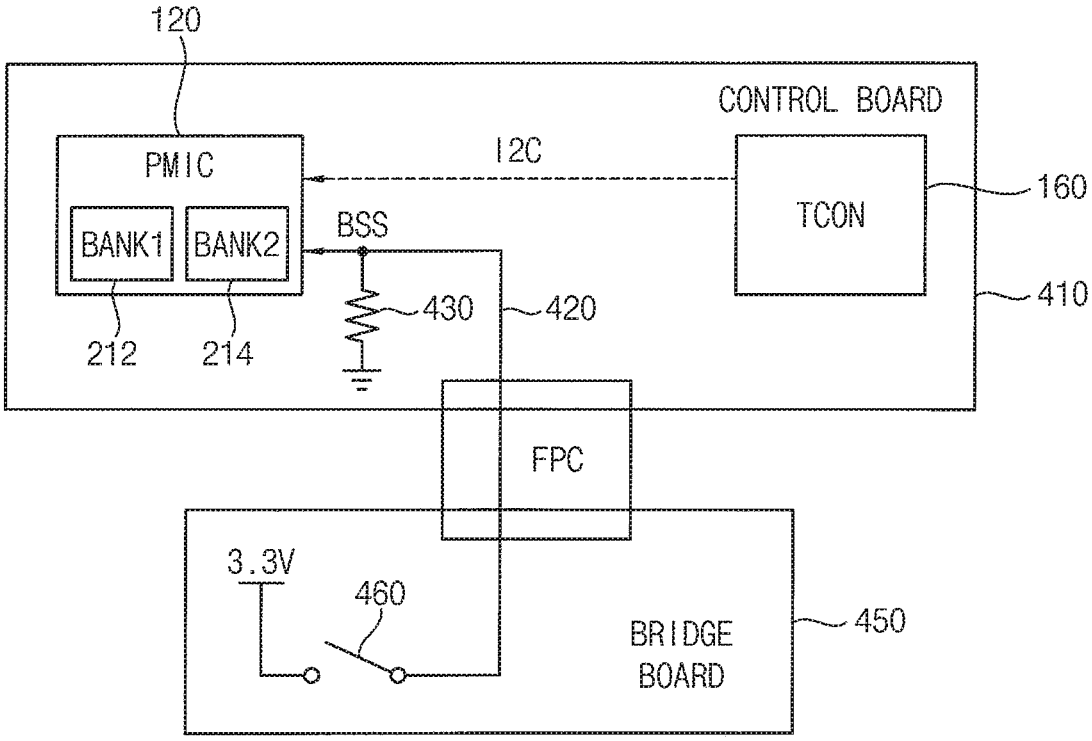
FIG. 4 is a block diagram illustrating a power management circuit according to example embodiments.
FIG. 5 is a diagram illustrating an example of first and second voltage information stored in first and second banks of a power management circuit according to example embodiments.
Figure 6:
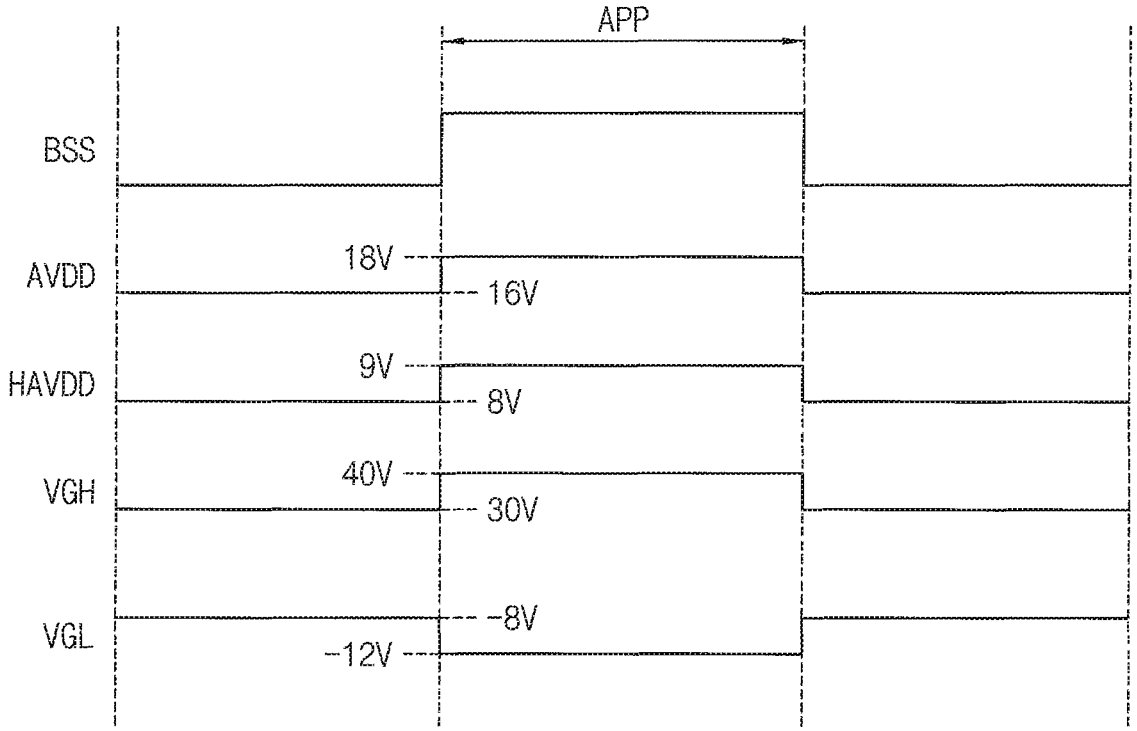
FIG. 6 is a timing diagram for describing an operation of a power management circuit while a test process for a display device is performed according to example embodiments.
Figure 7:
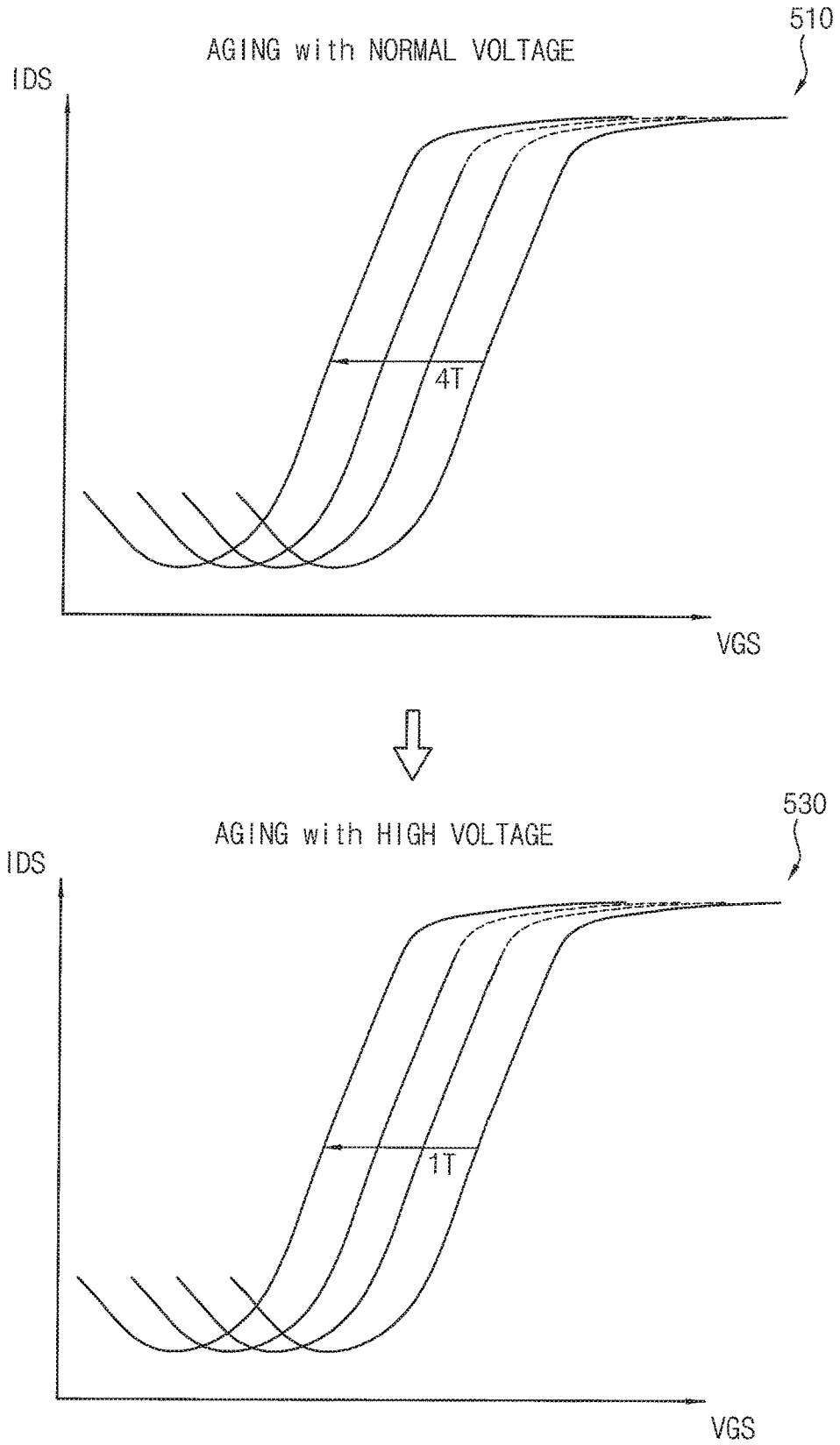
FIG. 7 is a diagram illustrating examples of changes with time during aging processes.

FIG. 3 is a flowchart illustrating a test process for a display device according to example embodiments, FIG. 4 is a block diagram illustrating a power management circuit according to example embodiments receiving a bank select signal from a bridge board, FIG. 5 is a diagram illustrating first and second voltage information stored in first and second banks of a power management circuit according to example embodiments, FIG. 6 is a timing diagram for describing an operation of a power management circuit while a test process for a display device is performed according to example embodiments, and FIG. 7 is a diagram illustrating a change with time during an aging process using panel driving voltages having normal voltage levels and a change with time during an aging process using panel driving voltages having high voltage levels.

Referring to FIGS. 1 through 3, after a display device 100 according to example embodiments is assembled or manufactured (S310), a test process for the display device 100 may be performed (S320 through S360). An assembling process for the display device 100 may include a cullet, clean and polarizer (CP) process that attaches a lower substrate and an upper substrate of a display panel 110, an on-chip lead bonding (OLB) process that attaches the display panel 110 and a data driver 140, a PCB bonding process that attaches the data driver 140 and a control board on which a power management circuit 120 and a timing controller 160 are mounted, etc.

The test process for the display device 100 may include a manual test (MT) process (S320), an aging process (S340) and a final test (FT) process (S360). The MT process (S320) for the display device 100 may drive the display device 100 to display a test pattern image, and may detect a line defect or a dot defect of the display device 100 with the unaided eye or by using a camera (e.g., a charge coupled device (CCD) camera). For example, during the MT process (S320), the control board of the display device 100 may be coupled to a set board that provides an input voltage VIN and input image data IDAT corresponding to the test pattern image. The MT process (S320) may be an automatic manual test (AMT) process. The display device 100 that is determined to be defective by the MT process (S320) may be discarded or repaired.

Before the aging process (S340), a bank select signal BSS having a first level may be provided to a power management circuit 120 (S330). As illustrated in FIG. 4, the control board 410 on which the power management circuit (PMIC) 120 and the timing controller (TCON) 160 are mounted may be coupled to a bridge board 450 through a flexible printed circuit FPC. The bridge board 450 may include a switch 460 that selectively transfers a voltage of the first level (e.g., about 3.3V), and the power management circuit (PMIC) 120 may receive, as the bank select signal BSS, the voltage of the first level through the switch 460 from the bridge board 450.

The power management circuit (PMIC) 120 may include a first bank (BANK1) 212 that stores first voltage information VI1 and a second bank (BANK2) 214 that stores second voltage information VI2. The first and second voltage information VI1 and VI2 may be substantially simultaneously written by an external circuit or an external device to the first and second banks 212 and 214. A voltage information storage 210 including the first and second banks 212 and 214 may be implemented with a nonvolatile memory device. For example, the first and second voltage information VI1 and VI2 may be substantially simultaneously written to the first and second banks 212 and 214 before an assembling process (S310) of the display device 100, or may be substantially simultaneously written after the assembling process (S310) of the display device 100 and before the MT process (S320). In embodiments, the first and second voltage information VI1 and VI2 may be substantially simultaneously written from the timing controller 160 through an inter-integrated circuit (I2C) communication to the first and second banks 212 and 214 at power-on of the display device 100. In this case, the voltage information storage 210 including the first and second banks 212 and 214 may be implemented with a volatile memory device.

Before the aging process (S340) is performed, the power management circuit 120 may generate panel driving voltages (e.g., an analog driving voltage AVDD, a half analog driving voltage HAVDD, a high gate voltage VGH and a low gate voltage VGL). The panel driving voltages may have first voltage levels (e.g., high voltage levels) corresponding to the first voltage information VI1 stored in the first bank 212 in response to the bank select signal BSS having the first level. For example, as illustrated in FIG. 5, the first bank 212 may store high voltage information HVI as the first voltage information VI1. The high voltage information HVI may represent about 18V as a voltage level of the analog driving voltage AVDD, about 9V as a voltage level of the half analog driving voltage HAVDD, about 40V as a voltage level of the high gate voltage VGH, and about −12V as a voltage level of the low gate voltage VGL.

As described above, since the bank select signal BSS having the first level is provided to the power management circuit 120 before the aging process (S340), the aging process (S340) may be performed by using the panel driving voltages having the high voltage levels. As illustrated in FIG. 6, during a period APP while the aging process (S340) is performed, the control board 410 may be coupled to the set board that provides the input voltage VIN and the input image data IDAT through the bridge board 450, the power management circuit 120 may receive the bank select signal BSS having the first level from the bridge board 450, and the power management circuit 120 may generate the analog driving voltage AVDD of about 18V, the half analog driving voltage HAVDD of about 9V, the high gate voltage VGH of about 40V and the low gate voltage VGL of about −12V. Through the aging process (S340), transistors (of pixels PX or an ASG driver 150) included in the display panel 110 may be changed by aging (e.g., through use and accelerated wear).

As described above, since the aging process (S340) is not performed with the panel driving voltages having normal voltage levels, but by using the panel driving voltages having the high voltage levels, a time required for the aging process (S340) may be reduced. In a comparative example of aging 510 in FIG. 7, when the aging process (S340) is performed by using the panel driving voltages having the normal voltage levels, the aging process (S340) should be performed for about a time 4T to allow the change with time of voltage (VGS)-current (IDS) characteristics of the transistors included in the display panel 110 to occur. However, as illustrated in embodiments of the invention represented by 530 in FIG. 7, when the aging process (S340) is performed by using the panel driving voltages having the high voltage levels, the aging process (S340) may be performed for about a time IT to allow the change with time of the voltage (VGS)-current (IDS) characteristics of the transistors included in the display panel 110 to occur. Thus, the time required for the aging process (S340) may be reduced to a quarter of what it would be.

After the aging process (S340), the bank select signal BSS having a second level (e.g., a low level) may be provided to the power management circuit 120 (S350). As illustrated in FIG. 4, a line 420 on the control board 410 through which the bank select signal BSS is transferred to a bank select pin BSP of the power management circuit 120 may be coupled to a pull-down termination resistor 430. Thus, when the bank select signal BSS having the first level (e.g., the high level) is not provided to the line 420, the bank select signal BSS that has the second level (e.g., the low level) by the pull-down termination resistor 430 may be provided to the bank select pin BSP of the power management circuit 120.

Further, after the aging process (S340), the power management circuit 120 may generate the panel driving voltages having second voltage levels (e.g., normal voltage levels) corresponding to the second voltage information VI2 stored in the second bank 214 in response to the bank select signal BSS having the second level. For example, as illustrated in FIG. 5, the second bank 214 may store normal voltage information NVI as the second voltage information VI2. The normal voltage information NVI may represent about 16V as the voltage level of the analog driving voltage AVDD, about 8V as the voltage level of the half analog driving voltage HAVDD, about 30V as the voltage level of the high gate voltage VGH, and about −8V as the voltage level of the low gate voltage VGL. Thus, as illustrated in FIG. 6, after the period APP of the aging process (S340), the power management circuit 120 may generate the analog driving voltage AVDD of about 16V, the half analog driving voltage HAVDD of about 8V, the high gate voltage VGH of about 30V and the low gate voltage VGL of about −8V. Accordingly, at both the FT process (S360) and a normal driving operation after the FT process (S360), the power management circuit 120 may generate the panel driving voltages having the normal voltage levels.

The FT process (S360) may be performed on the display device 100 where the aging process (S340) is performed. The FT process (S360) may be performed in a manner similar to the MT process (S320), and may detect the line defect or the dot defect of the display device 100 where the change with time occurs.

As described above, in the display device 100 including the power management circuit 120 according to example embodiments, the panel driving voltages having the high voltage levels may be generated while the aging process (S340) is performed, and the panel driving voltages having the normal voltage levels may be generated while the aging process (S340) is not performed. Accordingly, although a plurality of data writing operations that writes different voltage information for the panel driving voltages to the power management circuit 120 is not performed before and after the aging process (S340), the panel driving voltages having the high voltage levels may be generated during the aging process (S340), and the panel driving voltages having the normal voltage levels may be generated after the aging process (S340). Accordingly, the aging process (S340) may be efficiently performed by using the panel driving voltages having the high voltage levels, and the entire aging process time for the display device 100 may be reduced.

Figure 8:
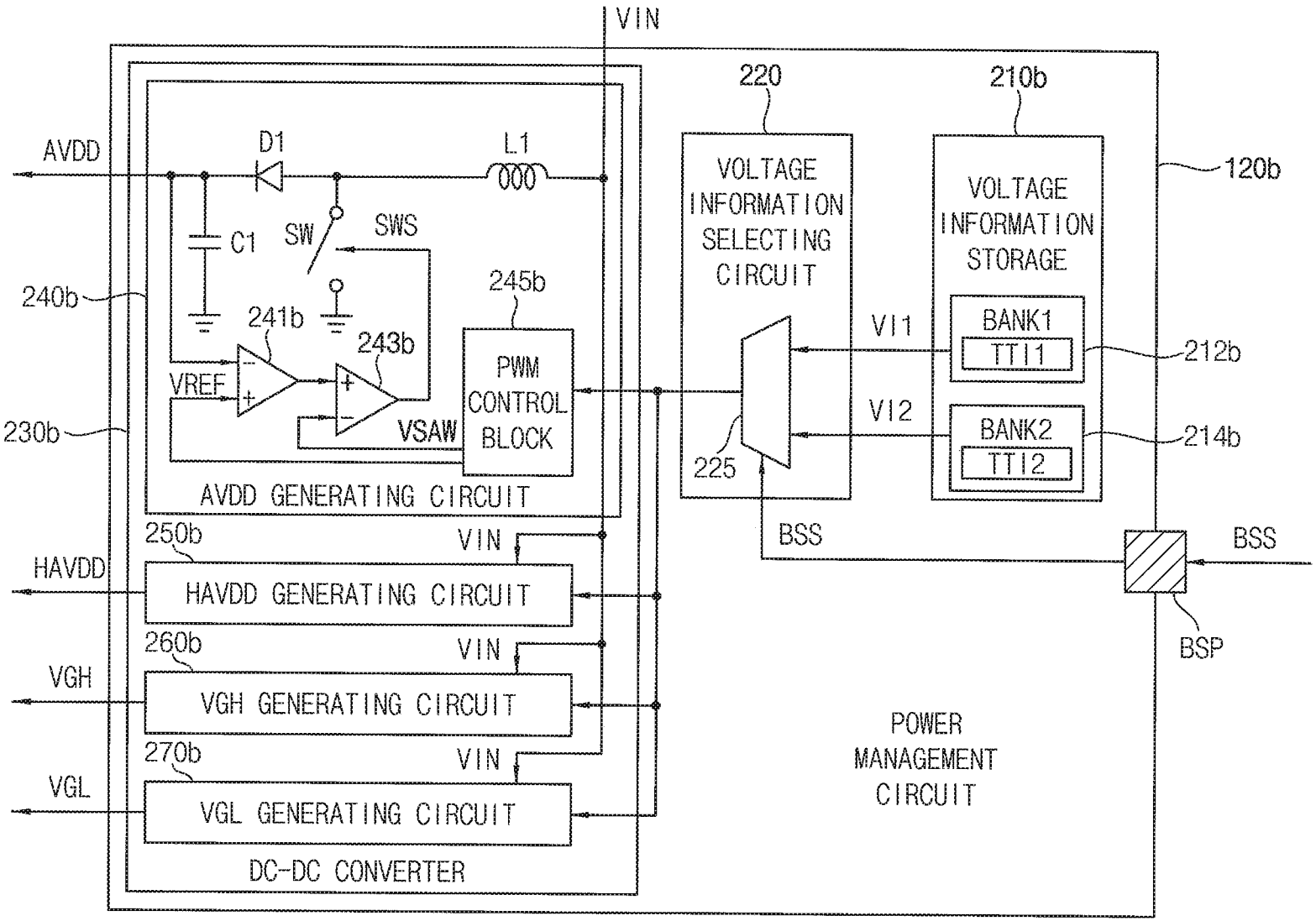
FIG. 8 is a block diagram illustrating a power management circuit according to example embodiments.
Figure 9:
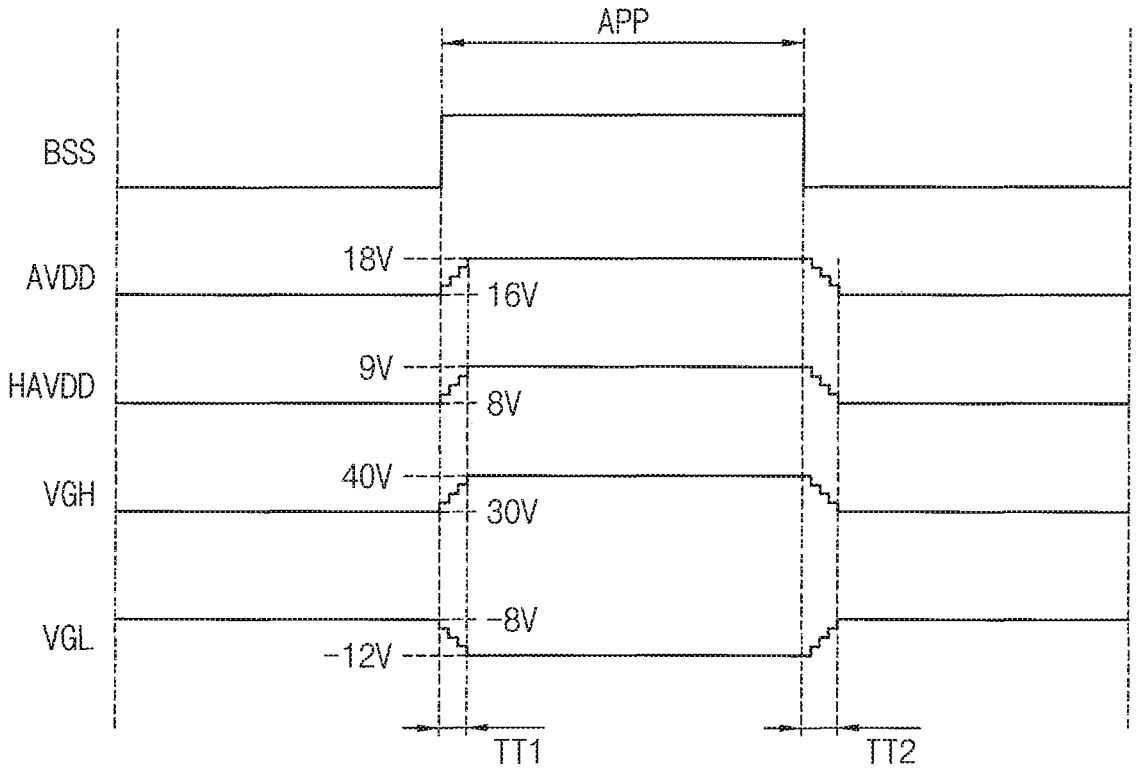
FIG. 9 is a timing diagram for describing an operation of a power management circuit while a test process for a display device is performed according to example embodiments.

FIG. 8 is a block diagram illustrating a power management circuit according to example embodiments, and FIG. 9 is a timing diagram for describing an operation of a power management circuit while a test process for a display device is performed according to example embodiments.

Referring to FIG. 8, a power management circuit 120*b* according to example embodiments may include a voltage information storage 210*b*, a bank select pin BSP, a voltage information selecting circuit 220 and a DC-DC converter 230*b*. The power management circuit 120*b* of FIG. 8 may have a similar configuration and a similar operation to a power management circuit 120*a* of FIG. 2, except that first voltage information VI1 stored in a first bank 212*b* may include first transition time information TTI1, second voltage information VI2 stored in a second bank 214*b* may include second transition time information TTI2, and the DC-DC converter 230*b* may gradually change voltage levels of panel driving voltages.

The first bank 212*b* of the voltage information storage 210*b* may store the first voltage information VI1 representing first voltage levels, and the second bank 214*b* of the voltage information storage 210*b* may store the second voltage information VI2 representing second voltage levels. The first voltage information VI1 may include the first transition time information TTI1 including a first transition time, and the second voltage information VI2 may include the second transition time information TTI2 including a second transition time. The voltage information selecting circuit 220 may selectively output the first voltage information VI1 or the second voltage information VI2 in response to a bank select signal BSS received through the bank select pin BSP.

The DC-DC converter 230*b* may generate the panel driving voltages having the first voltage levels based on the first voltage information VI1 when the first voltage information VI1 is output from the voltage information selecting circuit 220. The DC-DC converter 230*b* may generate the panel driving voltages having the second voltage levels based on the second voltage information VI2 when the second voltage information VI2 is output from the voltage information selecting circuit 220. To generate an analog driving voltage AVDD, a half analog driving voltage HAVDD, a high gate voltage VGH and a low gate voltage VGL as the panel driving voltages, the DC-DC converter 230*b* may include an analog driving voltage generating circuit 240*b*, a half analog driving voltage generating circuit 250*b*, a high gate voltage generating circuit 260*b* and a low gate voltage generating circuit 270*b*.

In response to the first voltage information VI1 including the first transition time information TTI1, the DC-DC converter 230*b* may gradually change the panel driving voltages from the second voltage levels to the first voltage levels for the first transition time represented by the first transition time information TTI1. In response to the second voltage information VI2 including the second transition time information TTI2, the DC-DC converter 230*b* may gradually change the panel driving voltages from the first voltage levels to the second voltage levels for the second transition time represented by the second transition time information TTI2.

To gradually change a voltage level of the analog driving voltage AVDD, as illustrated in FIG. 8, the analog driving voltage generating circuit 240*b* may include an inductor L1, a switching element SW, a diode D1, a capacitor C1, an error amplifier 241*b*, a comparator 243*b* and a PWM control block 245*b*. The error amplifier 241*b* may amplify a difference between the analog driving voltage AVDD and a reference voltage VREF provided from the PWM control block 245*b*. The comparator 243*b* may generate a switching signal SWS by comparing an output voltage of the error amplifier 241*b* and a saw-tooth voltage VSAW provided from the PWM control block 245*b*. The PWM control block 245*b* may receive the first transition time information TTI1 or the second transition time information TTI2, and may gradually change the reference voltage VREF for the first transition time or the second transition time. The analog driving voltage generating circuit 240*b* may gradually change the voltage level of the analog driving voltage AVDD based on the gradually changed reference voltage VREF. The half analog driving voltage generating circuit 250*b*, the high gate voltage generating circuit 260*b* and the low gate voltage generating circuit 270*b* may also have a similar configuration to the analog driving voltage generating circuit 240*b*, and may gradually change the half analog driving voltage HAVDD, the high gate voltage VGH and the low gate voltage VGL in response to the first transition time information TTI1 or the second transition time information TTI2.

For example, as illustrated in FIG. 9, the DC-DC converter 230*b* may gradually (e.g., step-by-step) increase the voltage levels of the analog driving voltage AVDD, the half analog driving voltage HAVDD, the high gate voltage VGH and the low gate voltage VGL for the first transition time TT1 represented by the first transition time information TTI1 from a start time point of a period APP of an aging process. Further, the DC-DC converter 230*b* may gradually decrease the voltage levels of the analog driving voltage AVDD, the half analog driving voltage HAVDD, the high gate voltage VGH and the low gate voltage VGL for the second transition time TT2 represented by the second transition time information TTI2 from an end time point of the period APP of the aging process. Although FIG. 9 illustrates an example where the DC-DC converter 230*b* step-by-step changes the voltage levels of the panel driving voltages, the DC-DC converter 230*b* may linearly and smoothly change the voltage levels of the panel driving voltages.

Figure 10:
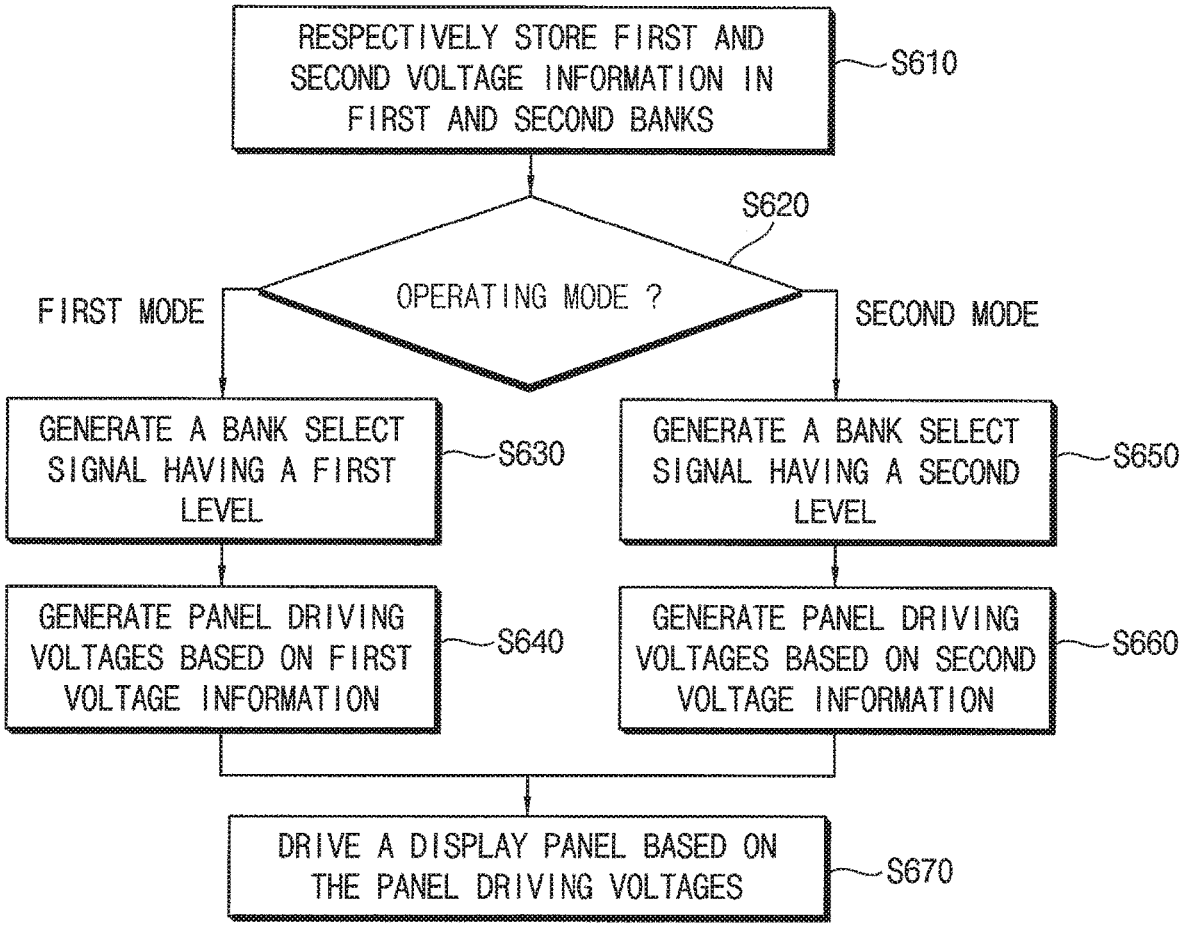
FIG. 10 a flowchart illustrating a method of driving a display device according to example embodiments.
Figures 11, 12:
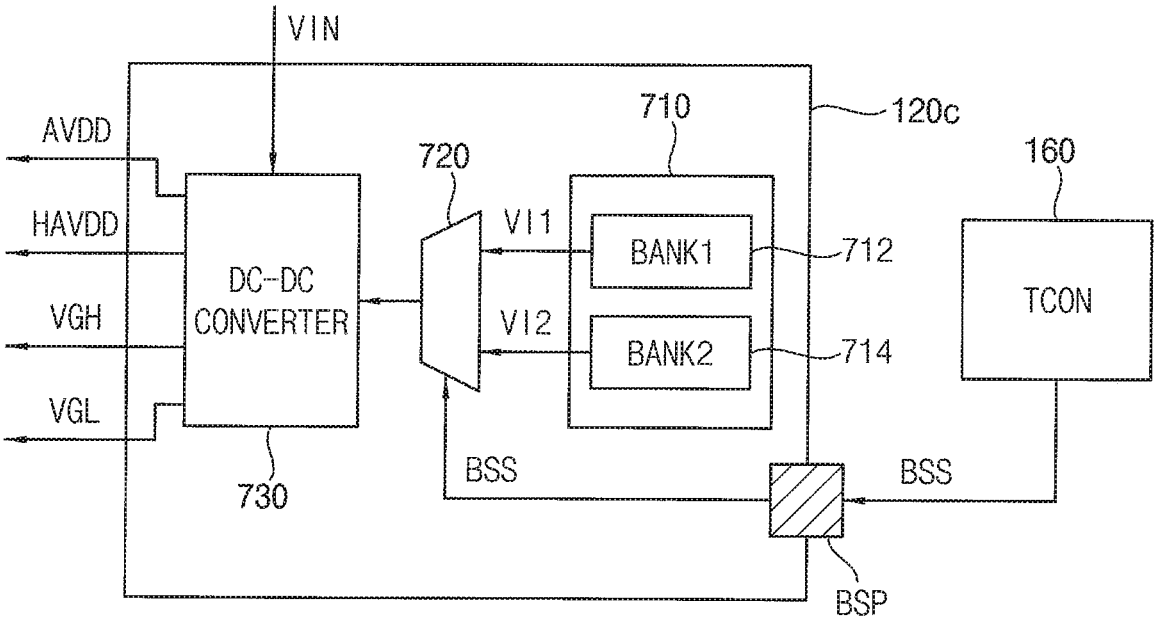
FIG. 11 is a block diagram illustrating a power management circuit and a timing controller included in a display device according to example embodiments.
FIG. 12 is a diagram illustrating an example of first and second voltage information stored in first and second banks of a power management circuit according to example embodiments.

FIG. 10 a flowchart illustrating a method of driving a display device according to example embodiments, FIG. 11 is a block diagram illustrating a power management circuit and a timing controller included in a display device according to example embodiments, and FIG. 12 is a diagram illustrating first and second voltage information stored in first and second banks of a power management circuit according to example embodiments.

Referring to FIGS. 1, 10 and 11, first and second voltage information VI1 and VI2 may be respectively stored in first and second banks 712 and 714 of a power management circuit 120*c* of a display device 100 according to example embodiments (S610). In embodiments, a voltage information storage 710 including the first and second banks 712 and 714 may be implemented with a nonvolatile memory device, and the first and second voltage information VI1 and VI2 may be substantially simultaneously written to the first and second banks 212 and 214 by an external device when the display device 100 is manufactured. In embodiments, the voltage information storage 710 including the first and second banks 712 and 714 may be implemented with a volatile memory device, and the first and second voltage information VI1 and VI2 may be substantially simultaneously written to the first and second banks 212 and 214 by a timing controller 160 at power-on of the display device 100.

The timing controller 160 of the display device 100 may generate a bank select signal BSS having a first level or a second level according to an operating mode of the display device 100 (S620, S630 an S50). In a case where the display device 100 operates in a first mode (S620), the timing controller 160 may generate the bank select signal BSS having the first level (S630). Furthermore, in a case where the display device 100 operates in a second mode (S620), the timing controller 160 may generate the bank select signal BSS having the second level (S650). A bank select pin BSP of the power management circuit 120*c* may be coupled to the timing controller 160, and may receive the bank select signal BSS from the timing controller 160. A voltage information selecting circuit 720 of the power management circuit 120*c* may output the first voltage information VI1 in response to the bank select signal BSS having the first level received through the bank select pin BSP in the first mode of the display device 100, and may output the second voltage information VI2 in response to the bank select signal BSS having the second level received through the bank select pin BSP in the second mode of the display device 100. A DC-DC converter 730 of the power management circuit 120*c* may generate panel driving voltages AVDD, HAVDD, VGH and VGL based on the first voltage information VI1 output from the voltage information selecting circuit 720 in the first mode of the display device 100 (S640), and may generate the panel driving voltages AVDD, HAVDD, VGH and VGL based on the second voltage information VI2 output from the voltage information selecting circuit 720 in the second mode of the display device 100 (S660).

The first mode may be a two-dimensional mode in which the display device 100 displays a two-dimensional image, and the second mode may be a three-dimensional mode in which the display device displays a three-dimensional image (e.g., by using a lenticular lens, a parallax barrier, and other similar methods). For example, as illustrated in FIG. 12, the first bank 712 may store, as the first voltage information VI1, a two-dimensional voltage information 2DVI for the panel driving voltages AVDD, HAVDD, VGH and VGL suitable for the two-dimensional mode. The two-dimensional voltage information 2DVI may represent about 16V as a voltage level of an analog driving voltage AVDD, may represent about 8V as a voltage level of a half analog driving voltage HAVDD, may represent about 30V as a voltage level of a high gate voltage VGH, and may represent about −8V as a voltage level of a low gate voltage VGL. Furthermore, as illustrated in FIG. 12, the second bank 714 may store, as the second voltage information VI2, a three-dimensional voltage information 3DVI for the panel driving voltages AVDD, HAVDD, VGH and VGL suitable for the three-dimensional mode. The three-dimensional voltage information 3DVI may represent about 20V as the voltage level of the analog driving voltage AVDD, about 10V as the voltage level of the half analog driving voltage HAVDD, about 30V as the voltage level of the high gate voltage VGH, and about −8V as the voltage level of the low gate voltage VGL. Thus, the power management circuit 120*c* may generate the analog driving voltage AVDD of about 16V, the half analog driving voltage HAVDD of about 8V, the high gate voltage VGH of about 30V and the low gate voltage VGL of about −8V in the two-dimensional mode, and may generate the analog driving voltage AVDD of about 20V, the half analog driving voltage HAVDD of about 10V, the high gate voltage VGH of about 30V, and the low gate voltage VGL of about −8V in the three-dimensional mode. In embodiments, the first mode may be a standard dynamic range (SDR) mode in which the display device 100 displays an image with a standard dynamic range, and the second mode may be a high dynamic range (HDR) mode in which the display device 100 displays an image with a high dynamic range.

A panel driver 130 may drive the display panel 110 based on the panel driving voltages AVDD, HAVDD, VGH and VGL provided from the power management circuit 120*c* (S670). For example, the panel driver 130 may drive the display panel 110 based on the panel driving voltages AVDD, HAVDD, VGH and VGL generated based on the first voltage information VI1 in the first mode, and may drive the display panel 110 based on the panel driving voltages AVDD, HAVDD, VGH and VGL generated based on the second voltage information VI2 in the second mode.

As described above, the display device 100 including the power management circuit 120*c* according to example embodiments may generate the panel driving voltages AVDD, HAVDD, VGH and VGL based on the first voltage information VI1 in response to the bank select signal BSS having the first level in the first mode (e.g., the two-dimensional mode, the SDR mode, etc.), and may generate the panel driving voltages AVDD, HAVDD, VGH and VGL based on the second voltage information VI2 in response to the bank select signal BSS having the second level in the second mode (e.g., the three-dimensional mode, the HDR mode, etc.). Accordingly, the voltage levels of the panel driving voltages AVDD, HAVDD, VGH and VGL may be efficiently changed according to the operating mode of the display device 100.

Figure 13:
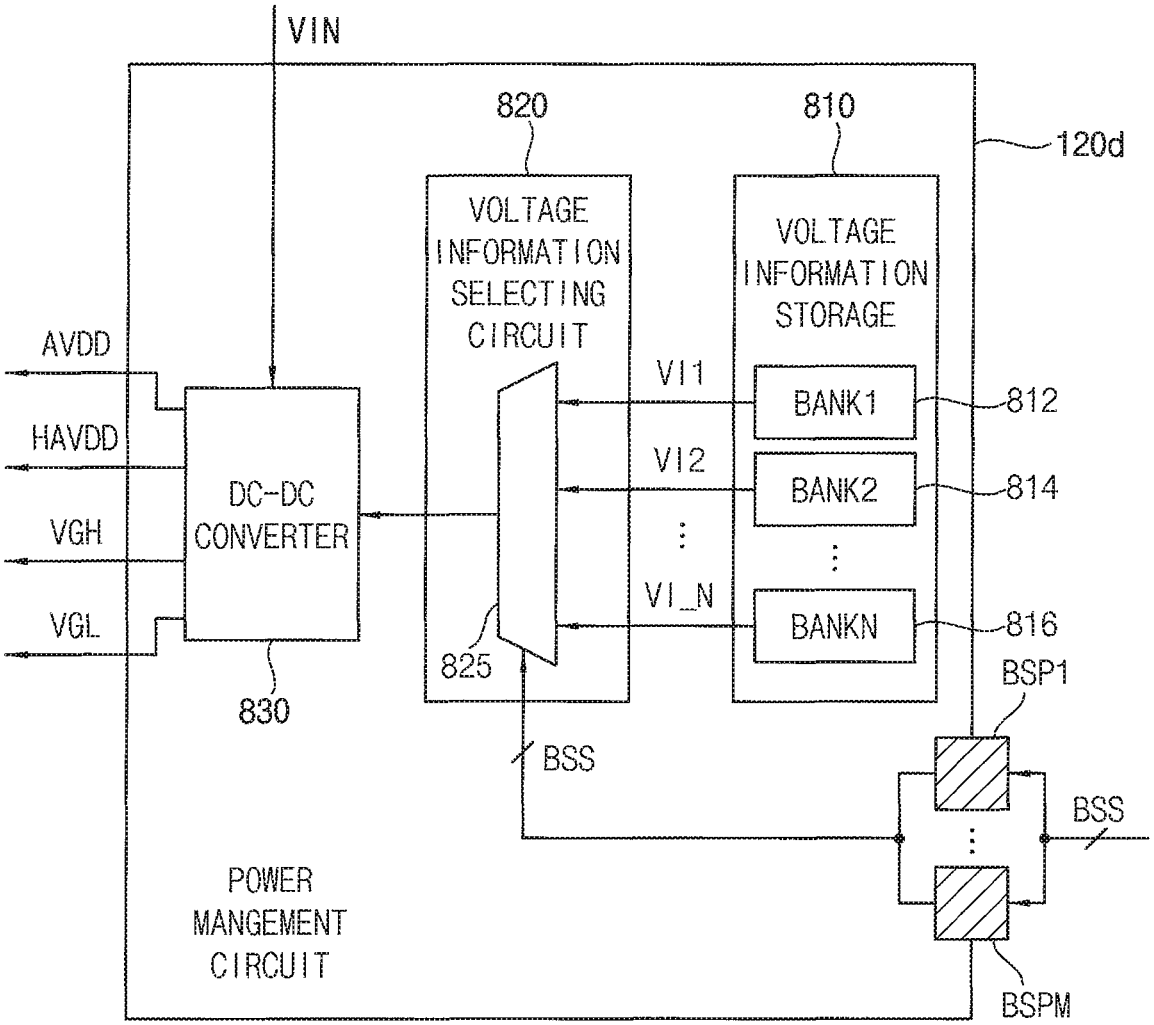
FIG. 13 is a block diagram illustrating a power management circuit according to example embodiments.

FIG. 13 is a block diagram illustrating a power management circuit according to example embodiments.

Referring to FIG. 13, a power management circuit 120*d* according to example embodiments may include a voltage information storage 810, at least one bank select pin BSP1, . . . , BSPM, a voltage information selecting circuit 820 and a DC-DC converter 830. The power management circuit 120*d* of FIG. 13 may have a similar configuration and a similar operation to a power management circuit 120*a* of FIG. 2, except that the voltage information storage 810 may include N banks 812, 814, . . . , 816, and the power management circuit 120*d* may include M bank select pins BSP1, . . . , BSPM.

The voltage information storage 810 may include the N banks 812, 814, . . . , 816 that store N voltage information VI1, VI2, . . . , VI_N, where N is an integer greater than 1. The power management circuit 120*d* may include, M bank select pins BSP1, . . . , BSPM, (M may be an integer that satisfies an equation "N≤2^M<2*N"). For example, the M may be 2 in a case where the N is 3 or 4, and the M may be 3 in a case where the N ranges from 5 to 8. While an aging process for a display device is performed, the M bank select pins BSP1, . . . , BSPM may receive the bank select signal BSS from a bridge board coupled to a control board on which the power management circuit 120*d* is mounted. In embodiments, the M bank select pins BSP1, . . . , BSPM may receive the bank select signal BSS from a timing controller included in the display device.

The voltage information selecting circuit 820 may include a multiplexer 825 that selects one voltage information of the N voltage information VI1, VI2, . . . , VI_N respectively stored in the N banks 812, 814, . . . , 816 in response to the bank select signal BSS received through the M bank select pins BSP1, . . . , BSPM, and outputs the selected voltage information. The DC-DC converter 830 may generate panel driving voltages having voltage levels represented by the selected voltage information output from the voltage information selecting circuit 820. The panel driving voltages generated by the DC-DC converter 830 may include an analog driving voltage AVDD and a half analog driving voltage HAVDD provided to a data driver included in the display device, and may further include a high gate voltage VGH and a low gate voltage VGL provided to a gate driver included in the display device.

As described above, the power management circuit 120*d* according to example embodiments may store the N voltage information VI1, VI2, . . . , VI_N, may select the voltage information of the N voltage information VI1, VI2, . . . , VI_N in response to the bank select signal BSS received through the M bank select pins BSP1, . . . , BSPM, and may generate the panel driving voltages having the voltage levels represented by the selected voltage information. Accordingly, the voltage levels of the panel driving voltages may be efficiently changed.

Figure 14:
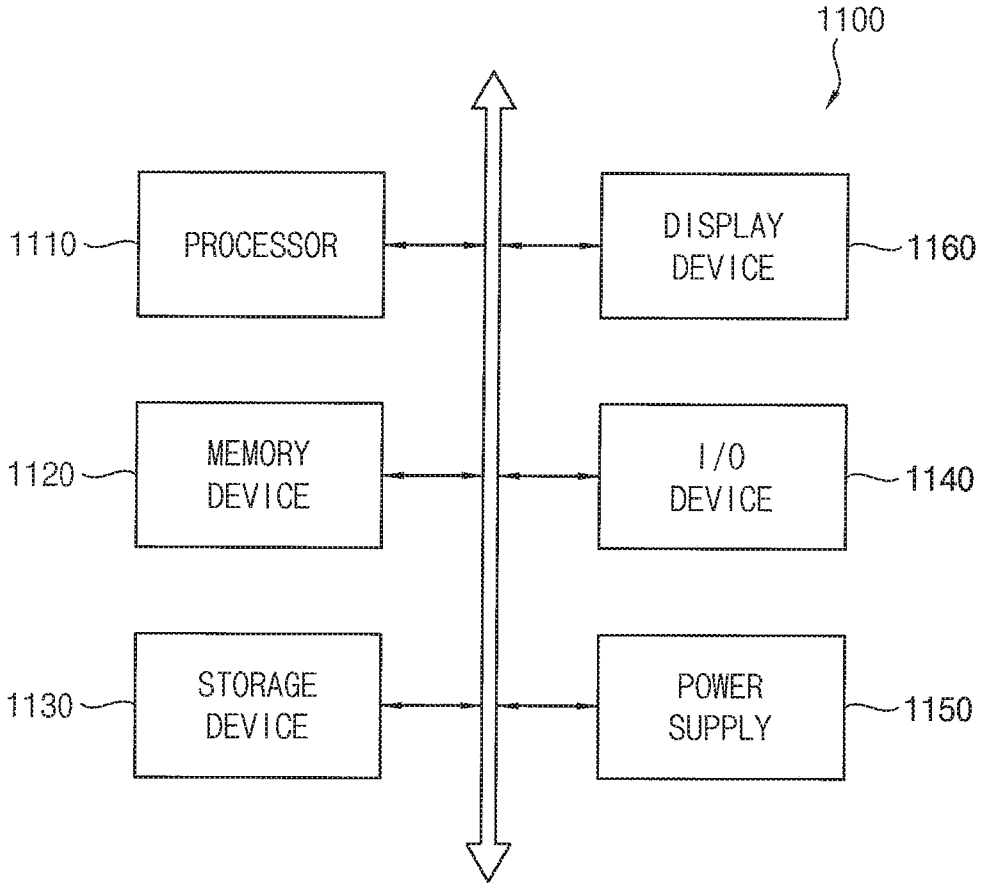
FIG. 14 is a block diagram illustrating an electronic device including a display device according to example embodiments.

FIG. 14 is a block diagram illustrating an electronic device including a display device according to example embodiments.

Referring to FIG. 14, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may be hardware for performing various computing functions or tasks. The processor 1110 may be an application processor (AP), a micro processor, a central processing unit (CPU), etc. The processor 1110 may be coupled to other components via an address bus, a control bus, a data bus, etc. The processor 1110 may be further coupled to an extended bus such as a peripheral component interconnection (PCI) bus.

The memory device 1120 may store data for operations of the electronic device 1100. For example, the memory device 1120 may include hardware of at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

The display device 1160 may store a plurality of voltage information, may select one voltage information of the plurality of voltage information in response to a bank select signal received through a bank select pin, and may generate panel driving voltages having voltage levels represented by the selected voltage information. Accordingly, the voltage levels of the panel driving voltages may be efficiently changed.

The inventive concepts may be applied to any display device 1160, and any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. In light of the present specification, those of ordinary skill in the art will readily appreciate that many modifications are possible in the example embodiments without materially departing from the novel teachings and advantages of the present inventive concept. Accordingly, all such modifications are intended to be included within the scope of the present inventive concept as defined in the claims. The foregoing is illustrative of various embodiments and is not to be construed as limited to the specific embodiments disclosed, and that modifications to the disclosed embodiments, as well as other embodiments, are intended to be included within the scope of the appended claims.

What is claimed is:

1. A power management circuit of a display device, the power management circuit comprising:

a voltage information storage comprising a first bank configured to store first voltage information corresponding to first voltage levels and a second bank configured to store second voltage information corresponding to second voltage levels different from the first voltage levels;

a bank select pin configured to receive a bank select signal;

a voltage information selecting circuit configured to selectively output the first voltage information stored in the first bank or the second voltage information stored in the second bank in response to the bank select signal received through the bank select pin; and a DC-DC converter configured to generate panel driving voltages having the first voltage levels based on the first voltage information when the first voltage information is output from the voltage information selecting circuit, and to generate the panel driving voltages having the second voltage levels based on the second voltage information when the second voltage information is output from the voltage information selecting circuit, wherein the voltage information selecting circuit receives the bank select signal having a first level through the bank select pin in a first mode of the display device, and outputs the first voltage information in response to receiving the bank select signal having the first level, and wherein the voltage information selecting circuit receives the bank select signal having a second level different from the first level through the bank select pin in a second mode of the display device, and outputs the second voltage information in response to receiving the bank select signal having the second level.

2. The power management circuit of claim 1, wherein, during an aging process for the display device, the voltage information selecting circuit receives the bank select signal having the first level through the bank select pin, and outputs the first voltage information in response to the bank select signal having the first level, and wherein, after the aging process, the voltage information selecting circuit receives the bank select signal having the second level through the bank select pin, and outputs the second voltage information in response to the bank select signal having the second level.

3. The power management circuit of claim 2, wherein, during the aging process, the bank select pin receives the bank select signal from a bridge board coupled to a control board on which the power management circuit is mounted.

4. The power management circuit of claim 2, wherein the first voltage information is high voltage information and the first voltage levels are high voltage levels, and wherein the second voltage information is normal voltage information and the second voltage levels are normal voltage levels.

5. The power management circuit of claim 1, wherein the bank select pin receives the bank select signal from a timing controller included in the display device.

6. The power management circuit of claim 1, wherein the first mode is a two-dimensional mode in which the display device displays a two-dimensional image, and the second mode is a three-dimensional mode in which the display device displays a three-dimensional image.

7. The power management circuit of claim 1, wherein the first mode is a standard dynamic range mode in which the display device displays an image with a standard dynamic range, and the second mode is a high dynamic range mode in which the display device displays an image with a high dynamic range.

8. The power management circuit of claim 1, wherein the voltage information storage is a nonvolatile memory device.

9. The power management circuit of claim 1, wherein the panel driving voltages generated by the DC-DC converter comprise an analog driving voltage and a half analog driving voltage provided to a data driver included in the display device, and further comprise a high gate voltage and a low gate voltage provided to a gate driver included in the display device.

10. The power management circuit of claim 1, wherein the first voltage information comprises first transition time information corresponding to a first transition time, wherein the second voltage information comprises second transition time information corresponding to a second transition time, and wherein the DC-DC converter is configured to gradually change the panel driving voltages from the second voltage levels to the first voltage levels for the first transition time in response to the first voltage information, and gradually change the panel driving voltages from the first voltage levels to the second voltage levels for the second transition time in response to the second voltage information.

11. A power management circuit of a display device, the power management circuit comprising:

a voltage information storage comprising N banks configured to collectively store N voltage information, where N is an integer greater than 1;

at least one bank select pin configured to receive a bank select signal;

a voltage information selecting circuit configured to selectively output one voltage information of the N voltage information stored in the N banks in response to the bank select signal received through the at least one bank select pin; and a DC-DC converter configured to generate panel driving voltages having voltage levels corresponding to the one voltage information based on the one voltage information output from the voltage information selecting circuit, wherein the panel driving voltages generated by the DC-DC converter comprise a high gate voltage and a low gate voltage provided to a gate driver included in the display device, and wherein the panel driving voltages generated by the DC-DC converter further comprise an analog driving voltage and a half analog driving voltage provided to a data driver included in the display device.

12. The power management circuit of claim 11, wherein the at least one bank select pin comprises M bank select pins, where M is an integer that satisfies an equation $N \leq 2^M < 2*N$.

13. The power management circuit of claim 11, wherein, during an aging process for the display device, the at least one bank select pin receives the bank select signal from a bridge board coupled to a control board on which the power management circuit is mounted.

14. The power management circuit of claim 11, wherein the at least one bank select pin receives the bank select signal from a timing controller included in the display device.

15. A display device comprising:

a display panel comprising a plurality of pixels;

a power management circuit configured to generate panel driving voltages; and a panel driver configured to drive the display panel based on the panel driving voltages, wherein the power management circuit comprises:

a voltage information storage comprising a first bank that stores first voltage information corresponding to first voltage levels and a second bank that stores second voltage information corresponding to second voltage levels different from the first voltage levels;

a bank select pin configured to receive a bank select signal;

a voltage information selecting circuit configured to selectively output the first voltage information stored in the first bank or the second voltage information stored in the second bank in response to the bank select signal received through the bank select pin; and a DC-DC converter configured to generate the panel driving voltages having the first voltage levels based on the first voltage information when the first voltage information is output from the voltage information selecting circuit, and to generate the panel driving voltages having the second voltage levels based on the second voltage information when the second voltage information is output from the voltage information selecting circuit, wherein the voltage information selecting circuit receives the bank select signal having a first level through the bank select pin in a first mode of the display device, and outputs the first voltage information in response to receiving the bank select signal having the first level, and wherein the voltage information selecting circuit receives the bank select signal having a second level different from the first level through the bank select pin in a second mode of the display device, and outputs the second voltage information in response to receiving the bank select signal having the second level.

16. The display device of claim 15, wherein, during an aging process for the display device, the voltage information selecting circuit receives the bank select signal having the first level through the bank select pin, and outputs the first voltage information in response to the bank select signal having the first level, and wherein, after the aging process, the voltage information selecting circuit receives the bank select signal having the second level through the bank select pin, and outputs the second voltage information in response to the bank select signal having the second level.

17. The display device of claim 16, wherein, during the aging process, the bank select pin receives the bank select signal from a bridge board coupled to a control board on which the power management circuit is mounted.

18. The display device of claim 16, wherein the first voltage information is high voltage information and the first voltage levels are high voltage levels, and wherein the second voltage information is normal voltage information and the second voltage levels are normal voltage levels.

* * * * *